US005285040A

United States Patent [19]

Brandberg et al.

[11] Patent Number: 5,285,040

[45] Date of Patent: Feb. 8, 1994

[54] MICROWAVE SUSCEPTOR WITH SEPARATE ATTENUATOR FOR HEAT CONTROL

[75] Inventors: Lawrence C. Brandberg, Edina; Jeffrey T. Watkins, Eden Prairie; Sara J. Risch, Edina, all of Minn.

[73] Assignee: Golden Valley Microwave Foods Inc., Edina, Minn.

[21] Appl. No.: 938,815

[22] Filed: Sep. 1, 1992

Related U.S. Application Data

[63] Continuation-in-part of Ser. No. 601,451, Oct. 19, 1990, which is a continuation of Ser. No. 456,159, Dec. 22, 1989, Pat. No. 4,970,358.

[51] Int. Cl.[5] ..... H05B 6/80

[52] U.S. Cl. ..... 219/745; 219/725; 426/107; 426/234; 99/DIG. 14

[58] Field of Search ..... 219/10.55 E, 10.55 F; 426/107, 109, 234, 241, 243; 99/DIG. 14

[56] References Cited

U.S. PATENT DOCUMENTS

| | | | |
|---|---|---|---|
| 4,190,757 | 2/1980 | Turpin et al. | 219/10.55 E |
| 4,264,668 | 4/1981 | Balla | 428/195 |
| 4,283,427 | 8/1981 | Winters et al. | 426/107 |
| 4,518,651 | 5/1985 | Wolfe, Jr. | 428/308.8 |
| 4,602,141 | 7/1986 | Naito et al. | 219/10.55 E |
| 4,640,838 | 2/1987 | Isakson et al. | 426/107 |
| 4,713,510 | 12/1987 | Quick et al. | 219/10.55 E |
| 4,806,718 | 2/1989 | Seaborne et al. | 219/10.55 E |
| 4,808,780 | 2/1989 | Seaborne et al. | 219/10.55 E |
| 4,810,845 | 3/1989 | Seaborne et al. | 219/10.55 E |
| 4,818,831 | 4/1989 | Seaborne et al. | 219/10.55 E |
| 4,864,089 | 9/1989 | Tighe et al. | 219/10.55 E |
| 4,876,423 | 10/1989 | Tighe et al. | 219/10.55 E |
| 4,904,836 | 2/1990 | Turpin et al. | 219/10.55 E |
| 4,914,266 | 4/1990 | Parks et al. | 219/10.55 E |
| 4,917,748 | 4/1990 | Harrison | 156/230 |
| 4,943,456 | 7/1990 | Pollart et al. | 428/34.3 |
| 4,970,358 | 11/1990 | Brandberg et al. | 219/10.55 F |

FOREIGN PATENT DOCUMENTS

| | | | |
|---|---|---|---|
| 0276654 | 8/1988 | European Pat. Off. | B05D 5A12 |

*Primary Examiner*—Philip H. Leung
*Attorney, Agent, or Firm*—James V. Harmon

[57] ABSTRACT

A thermocompensated susceptor laminate is described comprising a microwave transparent sheet, e.g., paper, paperboard or plastic, having two layers thereon. One layer is a microwave interactive susceptor layer, e.g., a dried dispersion comprising a film-forming vehicle together with microwave interactive particles such as metal, metal oxide, carbon or graphite that absorbs microwave energy to produce heat in a microwave oven. The second layer is an attenuator layer which includes electrically nonconductive thermocompensating particles of a mineral. One mineral attenuator is a hydrate containing bound water and having a dissociation temperature between about 100° F. and 500° F., at which temperature the bound water is released therefrom to prevent overheating of the laminate.

6 Claims, 2 Drawing Sheets

MICROWAVE SUSCEPTOR WITH SEPARATE ATTENUATOR FOR HEAT CONTROL

This is a continuation-in-part of U.S. patent application Ser. No. 601,451, filed Oct. 19, 1990, which is in turn a continuation of U.S. patent application Ser. No. 456,159, now U.S. Pat. No. 4,970,358.

FIELD OF THE INVENTION

The invention relates to controlling or attenuating the heat produced by a susceptor that produces heat when exposed to microwave energy.

BACKGROUND OF THE INVENTION

In the prior art, a variety of substances including metal particles, ferrites, carbon or graphite particles, oxides of the metals zinc, germanium, barium, tin, iron and the like have been incorporated into coatings for producing heat in a microwave oven, i.e. to act as a heating susceptor for the purpose of absorbing a portion of the microwave energy and converting it to heat. Various other chemical susceptors such as salts are employed in an aqueous solution for this purpose as described in U.S. Pat. No. 4,283,427, but a quantity of free water must be provided to dissolve the salt so that it is in an ionic form which will interact with the microwave energy to produce heat. This requires that the wet product be placed in a pouch that is sealed at its edges. This wet product has many disadvantages including its bulk, its fluidity and the complexity of the manufacturing operation. U.S. Pat. Nos. 4,264,668 and 4,518,651 describe coatings containing carbon black. However, it has been found that carbon-containing heat producing coatings, when heated in a microwave oven, can be subject to a runaway heating condition that often produces arcing, sparking, burning or charring of the backing sheet to which they are applied. U.S. Pat. Nos. 4,806,718; 4,808,780; 4,810,845 and 4,818,831 describe ceramic devices for microwave heating, primarily green ceramics, which employ a quantity of bound water to produce heating. The ceramic gel itself produces heat.

In developing the present invention it was found that when carbon was used alone with a film former, such as a standard ink base, that burning and uncontrolled temperature rise occurs. Many of the packages burst into flames when heated in a microwave oven. It was also found that when carbon was mixed with an aqueous acrylic dispersion, the resulting susceptor would burn the package. A rapid, uncontrolled temperature rise occurs. Discoloration appears at about 400° F. Then ignition follows almost immediately. The package starts to brown at about 400° F. and then quickly begins to burn which is, of course, unacceptable. Once the package begins to carbonize, this facilitates further heating and accelerates the burning reaction which causes burning to occur at an even faster rate. This can be referred to as runaway heating.

An important objective of the invention is to provide a microwave susceptor layer that can be applied at little or no pressure as a fluid and which, upon exposure to microwave heating, will produce a uniform heat without unacceptable arcing, popping, sparking or burning. It is another objective to obtain uniformity of heating in different portions of the package and also from one sample to another. One preferred susceptor composition should have characteristics that allow it to be applied as a fluid by a variety of methods including roll printing, silk screen printing, spraying, dipping, brushing and the like. The susceptor composition should preferably be useful with gravure printing, one application method found to allow especially good coating weight control. One kind of fluid susceptor, sometimes referred to herein for convenience as "ink," should be capable of being applied directly as one or more coating layers on a backing such as paper, paperboard or the like without the requirement for plastic carrier sheets or high pressure which increase production costs and capital requirements.

When applied by printing, a fluid-type susceptor composition should have all the qualities of a good printing ink including the proper rheological properties: viscosity, dilatency and thixotropy to avoid problems such as misting, splattering or dripping from freshly printed surfaces moving at high speed and must also transfer easily from the supply roll to the printing roll. The susceptor fluids or inks of the present invention should also produce coatings of uniform thicknesses and be able to form both a continuous and interrupted coating, e.g. a coating with a multiplicity of openings or uncoated spots within a coated area.

It is a further object of the invention to control, attenuate or stabilize the heat produced by a microwave interactive susceptor by providing a cooling effect at a selected temperature or at a plurality of temperatures within a selected temperature range to compensate for the heat produced by the microwave interactive material.

A more specific object is to control heating of a susceptor so that it can be used on paper without the paper charring or catching on fire.

When printing is the application method, another object is to enable printing of the susceptor to be accomplished using standard printing equipment at normal speeds, up to 1200 feet per minute. A further object is to provide a susceptor for heating foods which is food safe.

Yet another object is to improve the performance of commercially available microwave susceptors that employ vapor deposited semiconductive aluminum coatings which are applied under vacuum by electrodeposition to a paper or plastic film backing.

Another objective is to find a way of attenuating or modulating the heat produced by a susceptor of the type in which a semiconductive metal-containing layer, e.g., a thin, transparent, vacuum-electrodeposited layer of aluminum, is applied as a coating to a carrier such as a plastic film.

Still another object of the invention is to provide a new structural arrangement between the susceptor (which produces heat) and an attenuator substance which modifies, controls and attenuates the heat produced by the susceptor by providing a unique physicial relationship between the susceptor and the attentuator in which the attenuator and susceptor are not mixed together but nevertheless when the susceptor produces heat during exposure to microwave energy, the attenuator body or layer will attenuate, modulate or cool the susceptor and surrounding structure to thereby reduce or eliminate overheating, charring, burning, sparking, arcing and the like and in that way lessen the chance for the structure to be damaged or catch on fire as heating takes place.

Another object is to provide better temperature control, e.g., for a food that is best cooked at a particular temperature or for a food that is sensitive to exposure to high temperatures.

Another object is to find a way of allowing the application of a greater amount of attenuator material than heretofor or to apply a great enough amount of an attenuator to enhance one or more characteristics of the substrate, such as paper, to which the attenuator is applied; for example, to soften the paper during exposure to microwave energy.

These and other more detailed and specific objects of the invention will be apparent in view of the accompanying drawings and specification which set forth by way of example but a few of the various forms of the invention that will be apparent to those skilled in the art once the principles described herein are understood

SUMMARY OF THE INVENTION

The invention provides a thermocompensating susceptor. The susceptor structure preferably includes a microwave transparent backing formed, for example, from a plastic film, paper or paperboard that is stable during heating up to at least about 400° F. and a microwave interactive heat-producing susceptor layer applied to the backing. An attenuator layer which can be a coating layer or a component of the backing is provided in heat conductive relationship with the heat-producing susceptor layer.

The heat-producing susceptor layer comprises any suitable known composition such as a thin, usually transparent, semiconductive electrodeposited metal or metal-containing layer or a dried dispersion composed typically of an organic film-forming resin binder in which is dispersed microwave interactive particles selected to absorb microwave energy and convert it to heat.

The attenuator layer usually includes a matrix or film former in which is dispersed electrically nonconductive thermocompensating particles of a mineral attenuator such as a mineral that absorbs no microwave energy or a mineral hydrate containing bound water of crystallization and having a dissociation temperature in the range of between about 100° F. to 600° F. and preferably between about 250° F. to 450° F. When the attenuator is a non-hydrate such as titanium dioxide or zinc oxide, it may act as a heat sink and a radiator of heat to produce a cooling effect.

When the attenuator is a mineral hydrate attenuator, it functions to limit and control runaway heating of the microwave interactive heat-producing susceptor during heating in a microwave oven by providing a cooling effect. Prior to heating, water molecules are tightly bound in the hydrate compound. When heated, a hydrated attenuator retains water molecules until the initial dissociation temperature is reached and then begins to give them off. It appears to be the release of the water molecules which produces a cooling effect, thereby stabilizing the temperature of the packaging material until all of the water molecules have been released. However, because the water molecules are tightly bound in the hydrate, the attenuator coating can be considered dry to the touch and can be used to form a stable coating that can be exposed, e.g. on the outside of a package, if desired and preferably does not rub off easily.

The microwave interactive susceptor layer and the separate attenuator layer can each be applied by a variety of methods including printing, dipping, spraying, brushing and the like. In another form of the invention the attenuator is incorporated into the composition of a backing sheet or support sheet, e.g., a sheet of paper or paperboard to which a microwave interactive susceptor is applied.

THE FIGURES

DETAILED DESCRIPTION OF THE INVENTION

Figure 1:
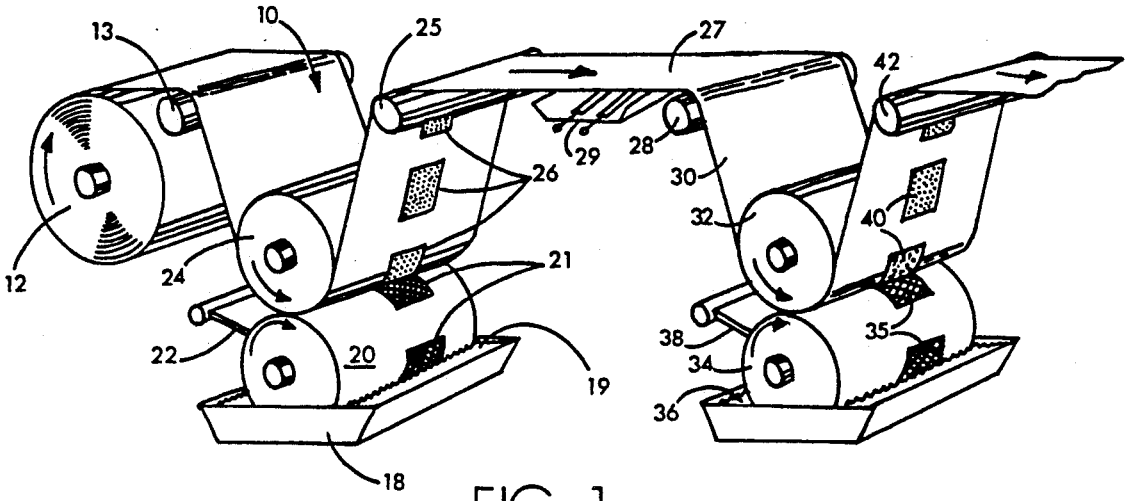
FIG. 1 is a perspective view showing a web of sheet material to which a susceptor coating and an attenuator coating are being applied in accordance with one form of the invention.

One form of the present invention employs a base sheet composed of a microwave transparent sheet material such as paper, paperboard or plastic that is transparent to microwave energy with a susceptor layer or coating as well as a separate attenuator coating thereon. One form of susceptor coating comprises a dispersion composed of a fluid vehicle or binder in which are uniformly suspended microwave interactive particles. The interactive particles are electrically conductive or at least semiconductive microwave interactive particles which produce heat in a microwave field. The separate attenuator coating contains an electrically nonconductive non-microwave interactive mineral attenuator such as a hydrate in particulate form for dissipating, spreading and/or modulating the energy absorbed and converted to heat by the conductive particles in the susceptor layer. The two layers (susceptor and attenuator) are in heat conductive relationship with one another. Suspended materials in both coating layers are composed of microscopic size particles that remain dispersed or in suspension in the coating which is most preferably a liquid prior to application to the base sheet. After being applied, each coating is dried. During heating the attenuator particles prevent localized energy buildup and runaway heating that would otherwise occur in the adjacent susceptor coating.

In accordance with the present invention the base sheet or backing sheet consists of a sheet of paper, paperboard, plastic film or other flexible microwave transparent organic polymeric sheet material. The base sheet material can, for example, be 15- to 50-pound greaseproof kraft paper, ordinary kraft paper, paperboard such as 18- or 20-point paperboard, or plastic film such as polyester, nylon, cellophane or the like.

When the coatings are in fluid form, each coating employs a fluid vehicle or film former that serves as a binder or matrix to hold each coating together and to the base sheet. The vehicle of the susceptor can comprise any suitable vehicle or binder such as an acrylic or maleic resin, e.g. maleic rosin ester, polyvinyl acetate, protein or soluble shellac. The best printability and drying is provided by acrylic resins. The shelf life and dispersion ability are also better with acrylic resins and, accordingly, an acrylic resin vehicle is preferred but is not essential. Thus, as the dispersion dries, the acrylic particles present in the dispersion coagulate or bond together to form a film. A liquid dispersant or solvent present in each liquid vehicle can be water with or without an amine such as ammonia.

A variety of other vehicles known to the art can also be used, but water-based vehicles are preferred. A suitable water based dispersion can be an alkaline solution of an acidic resin. Upon drying, the resin may become water insoluble and form a film.

In one embodiment of the invention the attenuator coating is an adhesive coating which is placed between two sheets to bond them together. Various adhesives such as a polyvinyl acetate adhesive emulsion can be employed alone or with an acrylic resin. The particulate attenuator, e.g., particles of a non-microwave interactive, electrically nonconductive mineral, are dispersed in the adhesive composition. The pH of the vehicle can be controlled as required, e.g., with sodium hydroxide. The vehicle typically contains about 50% to 80% solids. The balance is water.

One fluid type of susceptor coating will now be described in more detail. In this form of the invention, there are uniformly suspended in the susceptor vehicle microwave interactive heat-producing particles, e.g., carbon particles, optionally together with suspended metal particles such as aluminum, bronze or nickel particles in a minor amount of, say, about 1% to 20% by weight of the heat-producing particles.

The electrically conductive carbon particles dispersed in the vehicle should be composed of a suitable carbon black such as channel black, furnace black, lamp black or other suitable source of carbon. While various suitable carbon blacks can be used, one suitable carbon black is 90F Black (Inmont Printing Inks Division of BASF Corporation, Chicago, Ill., [I.P.I.]). Carbon black is typically present in an amount of about 1 to 5 times the amount of film forming resin (solids basis). One susceptor coating is about 5 parts carbon particles, 1 part acrylic resin particles and 94 parts water. In another form of the invention, the susceptor coating is not applied as a liquid but is instead a thin, transparent, usually semiconductive coating of metal, e.g., aluminum, applied by vacuum electrodeposition to plastic film.

The attenuator coating will now be described. In the attenuator coating layer are particles of an electrically nonconductive, microwave non-interactive inorganic mineral attenuator. If a hydrate is used as an attenuator, it will release water of crystallization endothermically for dissipating or compensating in part for the heat produced by the microwave interactive susceptor layer. The attenuator can be used in an amount from about 2 to 20 times, and most preferably about 10 to 12 times, the amount of carbon black or other susceptor (heater) present in the other layer. The attenuator is present in a sufficient amount to prevent localized overheating, sparking and burning of the susceptor.

When the attenuator is hydrated, various hydrated mineral attenuators can be employed in accordance with the invention to stabilize and control the heating characteristics of the microwave interactive susceptor. These hydrated mineral attenuator particles do not produce heat themselves. When heated in heat-conductive relationship with the heat-producing susceptor layer, they provide a cooling effect. Hydrated attenuator particles remain relatively inert until the dissociation temperature is reached. At this point water molecules are released to produce a cooling effect which stabilizes the temperature of the susceptor at the point reached when the water molecules begin to evolve until all of the water is driven off. In addition, each attenuator crystal may have sequential dissociation temperatures, i.e., $H_2O$ molecules begin to be liberated at temperatures much lower than the dissociation temperatures listed below in Table 1. when used in the invention, the onset of cooling thus occurs at a much lower temperature. Table 1 temperatures are taken from *The Handbook of Chemistry and Physics* and indicate temperatures at which the crystals become completely anhydrous. At that time normal heating continues.

Examples of suitable hydrated mineral attenuator materials that can be employed in accordance with the invention are listed in the following table.

TABLE 1

| Mineral Attenuator | Formula | Complete Dissociation Temperature |
|---|---|---|
| Zinc 1 Phenol 4 Sulfonate Octahydrate | $Zn(C_6H_5SO_4)_2.8H_2O$ | 257° F. |
| Zirconium Chloride Octahydrate | $ZrOCl_2.8H_2O$ | 302° F. |
| Thorium Hypo Phosphate Hydrate | $ThP_2O_6.11H_2O$ | 320° F. |
| Magnesium Chlorplatinate Hexahydrate | $MgPtCl_6.6H_2O$ | 356° F. |
| Alumina Trihydrate | $Al_2O_3.3H_2O$ | 392° F. |
| Zinc Iodate Dihydrate | $Zn(IO_3)_2.2H_2O$ | 392° F. |
| Thallium Sulfate Heptahydrate | $Tl_2(SO_4)_3.7H_2O$ | 428° F. |
| Sodium Pyrophosphate Hydrate | $Na_2H_2P_2O_7.H_2O$ | 428° F. |
| Potassium Ruthenate Hydrate | $K_2RuO_6.H_2O$ | 392° F. |
| Manganese Chloride Tetrahydrate | $MnCl_2.4H_2O$ | 389° F. |
| Magnesium Iodate Tetrahydrate | $Mg(IO_3)_2.4H_2O$ | 410° F. |
| Magnesium Bromate Hexahydrate | $Mg(BrO_3)_2.6H_2O$ | 392° F. |
| Magnesium Antimonate Hydrate | $MgOSb_2O_5.12H_2O$ | 392° F. |
| Dysprosium Sulfate Octahydrate | $Dy_2(SO_4)_3.8H_2O$ | 392° F. |

TABLE 1-continued

| Mineral Attenuator | Formula | Complete Dissociation Temperature |
|---|---|---|
| Cobalt Orthophosphate Octahydrate | $Co_3(PO_4)_2.8H_2O$ | 392° F. |
| Calcium Ditartrate Tetrahydrate | $CaC_4H_4O_6.4H_2O$ | 392° F. |
| Calcium Chromate Dihydrate | $CaCrO_4.2H_2O$ | 392° F. |
| Beryllium Oxalate Trihydrate | $BeC_2O_4.3H_2O$ | 428° F. |
| Sodium Thiosulfate Pentahydrate | $Na_2S_2O_3.5H_2O$ | 212° F. |
| Magnesium Sulfate Heptahydrate | $MgSO_4.7H_2O$ | 536° F. |
| Potassium Sodium Tartrate Tetrahydrate | KOCOCHOHCHOHCOONa.$4H_2O$ | 158° F. |
| Zinc Sulfate Heptahydrate | $ZnSO_4.7H_2O$ | — |

Examples of non-hydrated mineral attenuator particles are listed in Table 2.

TABLE 2

| Mineral Attenuator | Formula |
|---|---|
| Titanium Dioxide | $TiO_2$ |
| Zinc Oxide | ZnO |
| Silicon Dioxide | $SiO_2$ |
| Calcium Carbonate | $CaCO_2$ |
| Magnesium Oxide | MgO |
| Calcium Oxide | CaO |

In both coating layers, particles are preferably dispersed in the vehicles conventionally until uniform dispersion is obtained as will be understood by those skilled in the printing art. Only enough of the attenuator needs to be provided to reduce the tendency for overheating to occur in the susceptor layer. If too much is present the heating effect will be reduced, but if too little is present, hot spots or burning may occur.

Minor amounts of known ink additives can be provided for improving flow and drying properties as well as the properties of the finished susceptor and attenuator films. When an acrylic dispersion is used as a film former, an amine such as ammonia or an organic amine of any suitable known composition useful in printing inks can be employed to form a stable vehicle suspension. Sodium hydroxide can be used to control the pH.

The invention will be better understood by reference to the figures which illustrate the invention by way of example.

As shown in FIG. 1, a web of paper 10 unwound from supply roll 12 travels from left to right in the drawings. A microwave interactive susceptor that is initially a fluid dispersion, for convenience referred to herein as "ink," contained in supply pan 18 is picked up by a gravure roll 20 which is engraved with a repeating pattern 21 adapted to pick up the ink 19. Excess ink is removed by a doctor blade 22. The paper web 10 passes over roll 13 and beneath a back-up roll 24 which presses the web against roll 20 to pick up the ink carried in the engraved areas 21. This provides a succession of spaced apart rectangular susceptor patches 26. The printed web at 27 is dried as it passes over a radiant drier 29.

After the susceptor coating 26 has dried, the attenuator coating is applied. The paper web 10 passes next over an idler roller 28 and downwardly at 30. A microwave non-interactive attenuator coating in the form of a fluid dispersion is contained in a supply pan 36. The attenuator coating 36 is picked up by an applicator roll such as a gravure roll 34 which is engraved with a repeating pattern 35 that will pick up the attenuator dispersion 36. Excess attenuator 36 is removed by a doctor blade 37. The paper web 10 passes beneath the back-up roll 32 which presses the web against the printing roll 34, causing the paper to pick up the fluid attenuator coating 36 carried by the engraved areas 35 of the printing roll 34. The engraved areas 35 are in registration with the engraved areas 21 so that an attenuator coating layer 40 applied by the engraved areas 35 is of the proper size and location to cover the patches 26 of the microwave interactive susceptor coating.

Figure 2:
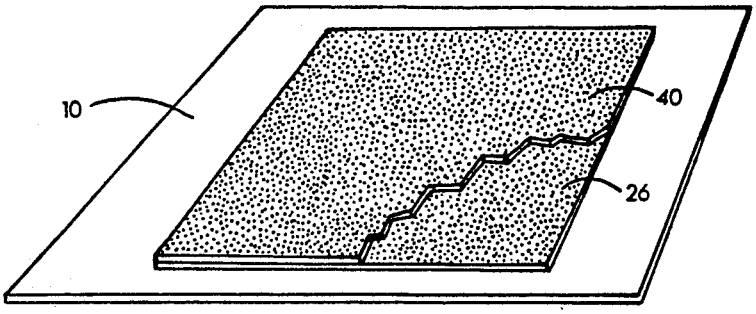
FIG. 2 is a perspective view showing a portion of the coated product prepared as in FIG. 1 with a portion of the upper coating broken away so that the lower coating layer can be clearly seen.

The finished susceptor product is shown in FIG. 2. It will be seen that the web of paper 10 which serves as a backing sheet has the susceptor coating 26 applied directly to an exposed surface while the attenuator coating layer 40 is applied upon the exposed surface of the susceptor coating 26 and is thus in heat transfer relationship with it. After the attenuator coating 40 is applied as shown, it is suitably dried, e.g., by the application of radiant heat or hot air (not shown). The sheet 10 then passes over a roll 42 and is formed into containers, e.g., bags, trays, or is cut into circular or rectangular food heating and supporting sheets, etc. It will be seen that the layers of susceptor 26 and attenuator 40, in this case, both have a rectangular shape and are of equal size. When desired, other shapes can be printed or another layer of flexible or non-flexible microwave transparent sheet material such as paper, paperboard or plastic (not shown) can be adhesively bonded over the coatings to enclose and encapsulate them between two sheets of microwave transparent material.

When spraying is used to apply either or both dispersions to the backing web 10, the rolls 20–24 and 32, 34' are replaced with spraying nozzles (not shown). In the alternative, the web can be immersed in the fluid susceptor and attenuator coatings, withdrawn and dried after each coat is applied.

The susceptor coating 26 can comprise between about 1–20 weight percent of conductive microwave interactive susceptor particles and about 0.5–5 weight percent of film-forming substrate or matrix. When carbon is used as the interactive material, it is preferred to use about 2–10 percent by weight of carbon black. In the attenuator coating, the amount of the attenuator material depends upon how much heat is produced, how effective the attenuator material is in cooling, how many bound water molecules are present, and the dissociation temperature.

When the susceptor layer 26 is to be used in a package for popping popcorn in a microwave oven, the printed susceptor patches can be a solidly printed rectangle about 4 to 6 inches on a side at a weight of typically about 2.5 pounds per ream (432,000 square inches). The carbon content in the dried ink film 26 is on the order of about 2%. The attenuator content of the coating 40 will be about 50% to 75% by weight of the dried film.

The viscosity of the fluid ink and the characteristics of the printing roll controls the basis weight of the film applied to the paper sheet 10. More or less water or other solvent can be used to control the viscosity within a limited range.

Halftone printing can be employed as a way of achieving a precise laydown of the dispersion. The desired basis weight of the susceptor patch 26 will depend on the formula of the dispersion. For popping popcorn, the basis weight of the patch is typically about 15–25 lb per ream (432,000 square inches). Better control of coating weight can also be provided with the printing roll 20 by changing the size of the half-tone dots engraved at 21, i.e., making them coarser or finer as will be understood by those skilled in the printing art. The amount of carbon or other heater present and the amount of the susceptor dispersion laid down control the amount of heat produced. The formula of the dispersion 36, and primarily the amount of attenuator, is adjusted to regulate the cooling effect.

The microwave interactive heat-producing substance, i.e., susceptor material used in the susceptor layer, will now be described in more detail. Various metals can be employed such as aluminum, copper, zinc, nickel, lead, stainless steel, iron, tin, chromium, manganese, silver, gold or their oxides. A variety of ferrites can be employed such as barium ferrite, zinc ferrite, magnesium ferrite, copper ferrite or other suitable ferromagnetic materials and alloys such as alloys of manganese, tin and copper or manganese, aluminum and copper, and carbides such as silicon carbide, iron carbide, strontium carbide and the like, as well as carbon. Of these, carbon is preferred because of its availability, cost and heating characteristics. The amount of microwave interactive susceptor such as carbon employed can be adjusted to obtain the desired rate of temperature rise to the dissociation point, say 392° F. The heat produced must be adjusted to fit the thermal requirements of the food item.

When a hydrated attenuator is used, adjustment of the hydrated attenuator present in the attenuator layer is accomplished by choosing one or a mixture of two or more of the appropriate dissociation temperature, as well as the number of water molecules bound in the compound. It is believed that a greater number of water molecules present in the crystal structure of the attenuator will increase its cooling capacity. If two or more different hydrated attenuator particles are employed, it may be possible in some cases to obtain a stepped heating curve if required by particular heating conditions or to release water molecules progressively to lengthen the temperature range over which the cooling effect can be achieved.

Figure 3:
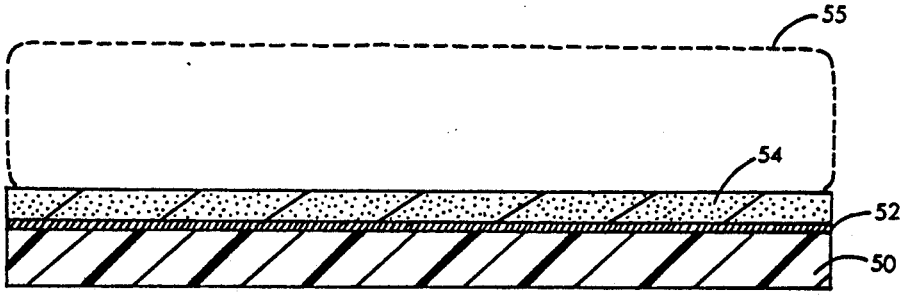
FIG. 3 is a greatly enlarged vertical sectional view of another form of the invention.

Refer now to FIG. 3 which illustrates how the invention can be applied to microwave susceptors of the type which employ a backing such as plastic film 50 to which is applied a thin, semiconductive layer 52 of metal by vacuum electrodeposition. In this embodiment the hydrated mineral attenuator particles can be incorporated in the matrix of a layer 54 applied to the metal coating as a liquid and dried like coating 40 or, if desired, applied on the opposite side of the backing 50 to keep the metallized film from overheating to the point where degradation is a problem. The layer 54 can be the same as layer 40 described above. The laminate thus produced can be formed into a package or used as a cut sheet for heating food 55 placed adjacent to the laminate and usually in contact with it as shown in the figure.

Figure 4:
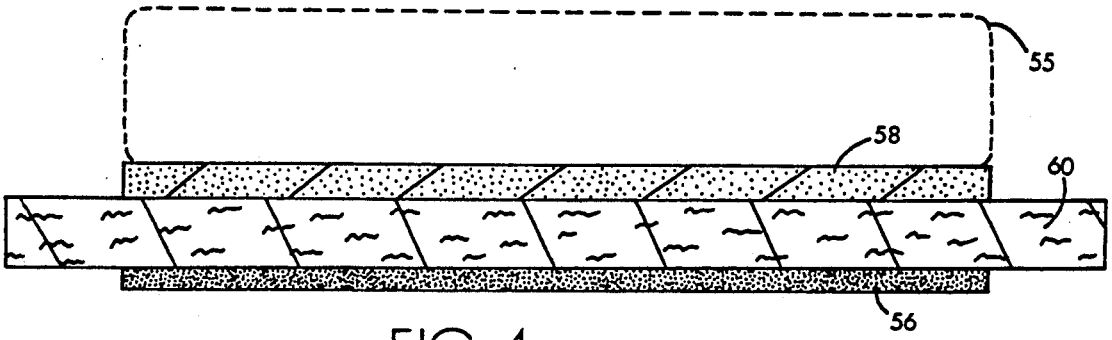
FIG. 4 is a greatly enlarged vertical sectional view of still another form of the invention.

Refer now to FIG. 4 which shows how an attenuator layer of the type described is applied as a separate layer 56 adjacent to a susceptor layer 58 containing carbon or other heat-producing susceptor and in heat conductive relationship with it to cool the susceptor during microwave heating. In this case the susceptor coating 58 and attentuator coating 56 are applied to opposite sides of a kraft paper backing sheet 60 and dried. The food 55 to be heated is placed during use on coating layer 58 in FIGS. 4 and 5. As in the preceding figures, the susceptor coating layer is carried by the paper backing sheet.

Figure 5:
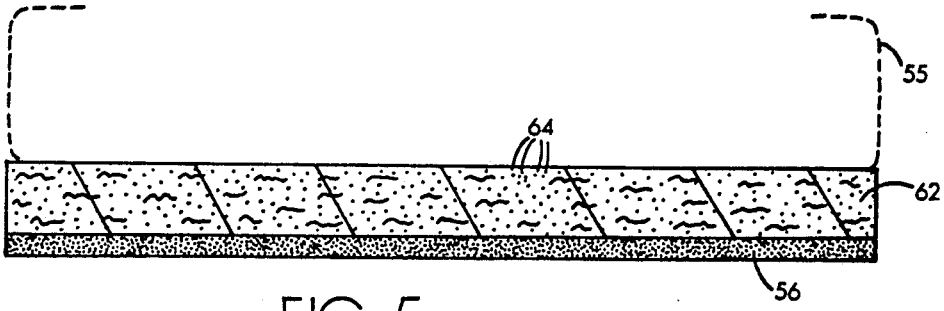
FIG. 5 is a vertical sectional view greatly enlarged of still another form of the invention.

Refer now to FIG. 5 which illustrates another embodiment of the invention. Shown in FIG. 5 is a laminate formed from a sheet of paper 62 of a special composition to which a dried microwave interactive susceptor coating 56 having the same composition as described above in connection with FIG. 4 or in Example 4 below is applied. The paper in this case contains attenuator material particles indicated by dots 64. The attenuator substance 64, in other words, is incorporated into the composition of the paper itself. The attenuator material particles 64 thus comprise an attenuator layer carried by the paper 62. In one example of the invention, the composition of the paper 62 (dry weight basis) is as follows:

EXAMPLE 1

| Component | % by weight |
|---|---|
| $Al_2O_3.3H_2O$ | 56 |
| Paper fibers | 44 |

In a second example of a paper composition the formulation is as follows:

EXAMPLE 2

| Component | % by weight |
|---|---|
| $Al_2O_3.3H_2O$ | 59 |
| Paper fibers | 41 |

In a third paper composition, the formulation is:

EXAMPLE 3

| Component | % by weight |
|---|---|
| $TiO_2$ | 56 |
| Paper fibers | 44 |

When the laminate thus formed is placed in a microwave oven and exposed to microwave energy, the susceptor coating 56 will interact with the microwave energy and begin to produce heat. However, the attenuator particles 64 contained in the paper 62 will modulate, attenuate and help control the heat produced, to thereby improve uniformity of heating and help prevent undesirable sparking, arcing, scorching or burning. When the attenuator is a hydrate, moisture will be liberated during the heating process, thereby cooling the laminate to reduce the tendency for excessive heating.

Figure 6:
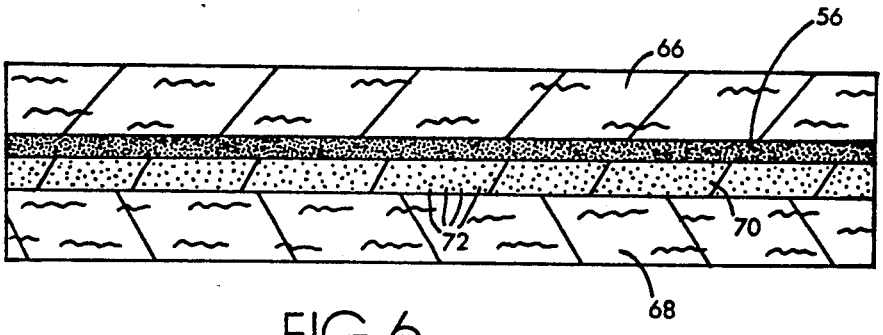
FIG. 6 is a greatly enlarged vertical sectional view of another form of the invention.

Refer now to FIG. 6 which illustrates another embodiment of the invention. As shown in the figure, two layers of paper such as a layer of 25-pound grease-proof kraft paper 66 and a second layer of ordinary 30-pound kraft paper 68 are bonded together by means of an adhesive layer 70. Prior to being bonded together, the sheet 66 is coated on its lower surface with a coating 56 of a dried microwave interactive susceptor of the same type already described in connection with FIGS. 4 and 5. The adhesive layer 70 can comprise any suitable packaging adhesive such as a resin or rubber-based adhesive, preferably with a solvent such as water in which is incorporated particles indicated at 72 of an attenuator substance of any suitable composition already described. The adhesive can be a water-based resin emulsion adhesive in which suspended resin particles coagulate when the water evaporates. One suitable adhesive is a polyvinyl acetate adhesive emulsion or a polyvinyl acetate copolymer adhesive emulsion, for example Duracet 12 by Franklin International, Inc. of Columbus, Ohio, or Electromek by Electromek Company of Carlstadt, N.J. These adhesives contain no attenuator. The attenuator is incorporated into the adhesive in any convenient way, such as a Sigma blade mixer. If desired, the adhesive 70 containing the attenuator particles 72 can have the same formula as described in Examples 1 and 2 below. It will be seen that the adhesive-containing attenuator layer 70 bonds the two sheets 66 and 68 together and is separate from but adjacent to the dried microwave interactive susceptor coating 56. In other words, in this case the attenuator layer includes an adhesive and the adhesive functions to bond the sheets 66 and 68 together. During heating in a microwave oven, heat is produced by the susceptor coating 56 and is modulated by the attenuator contained in the adhesive layer 70.

In one preferred form of the invention a stable dispersion containing hydrated attenuator particles is laminated between a relatively gas and vapor impervious sheet and a relatively porous sheet such as kraft paper which forms the outside surface of a container such as a food container. Upon heating, the flow of water molecules from the susceptor coating will be toward the outside of the container because of the porosity of the outer kraft paper layer, thereby venting the water vapor and other gases into the atmosphere to help prevent it from reaching the food.

The invention can be employed for heating, toasting, browning or crisping a variety of foods such as meat or fish patties, fish sticks, french fried potatoes, griddle foods including french toast, pancakes, waffles, pizza or for popping popcorn.

The invention will be better understood by reference to the following examples of several compositions employed in accordance with the invention. All quantities are expressed on a weight basis.

In each of the following examples a microwave interactive susceptor coating is applied by gravure printing to a paper backing of 25-pound greaseproof kraft paper at a basis weight of 2.4 grams/meter$^2$. The composition of the interactive susceptor coating is as follows:

EXAMPLE 4

| Component | Weight (grams) | Percent |
|---|---|---|
| $H_2O$ | 113.43 | 94.67 |
| Carbon Black | 4.96 | 4.14 |
| Acrylic Resin | 1.42 | 1.19 |
| Silicone Defoamer | .01 | .01 |
| | 119.82 | 100.00 |

After application, the carbon has a basis weight of about 1.9 grams/meter$^2$. The susceptor layer is dried by passing it over a heater like heater 29 of FIG. 1. Next, an attenuator coating is applied, e.g., by gravure printing in registration with, i.e., directly covering, the interactive susceptor layer. The size of the attenuator coating is preferably the same as or greater than the size of the susceptor layer.

The following compositions illustrate examples of a few of the various attenuator coating compositions that can be employed in accordance with the present invention.

EXAMPLE 5

Attenuator is Alumina Trihydrate ($Al_2O_3$. $3H_2O$)

| component | weight (grams) | percent |
|---|---|---|
| $Al_2O_3.3H_2O$ | 63.05 | 51.70 |
| NaOH (.01N) | 23.50 | 19.27 |
| $H_2O$ | 15.44 | 12.66 |
| Polyvinyl Acetate Adhesive Emulsion* | 18.00 | 14.76 |
| Acrylic Resin | 1.45 | 1.19 |
| Silicone Defoamer | .51 | .42 |
| | 121.95 | 100.00 |

*Duracet 12 by Franklin International, Inc. contains 44% moisture.

EXAMPLE 6

Attenuator is Alumina Trihydrate ($Al_2O_3.3H_2O$)

| component | weight (grams) | percent |
|---|---|---|
| $Al_2O_3.3H_2O$ | 76.86 | 53.80 |
| NaOH (.01N) | 24.00 | 16.80 |
| $H_2O$ | 30.15 | 21.10 |
| Polyvinyl Acetate Adhesive Emulsion | 9.00 | 6.30 |
| Acrylic Resin | 2.83 | 1.98 |
| Silicone Defoamer | .02 | .01 |
| | 142.86 | 99.99 |

EXAMPLE 7

Attenuator is Sodium Thiosulfate Pentahydrate ($Na_2S_2O_3.5H_2O$)

| component | weight (grams) | percent |
|---|---|---|
| $Na_2S_2O_3.5H_2O$ | 33.90 | 54.05 |
| $H_2O$ | 28.03 | 44.69 |
| Acrylic Resin | .78 | 1.24 |
| Silicone Defoamer | .01 | .02 |
| | 62.72 | 100.00 |

EXAMPLE 8

Attenuator is Magnesium Sulfate Heptahydrate ($MgSO_4.7H_2O$)

| component | weight (grams) | percent |
|---|---|---|
| $MgSO_4.7H_2O$ | 70.50 | 63.12 |
| $H_2O$ | 39.56 | 35.42 |
| Acrylic Resin | 1.62 | 1.45 |
| Silicone Defoamer | .01 | .01 |
| | 111.69 | 100.00 |

EXAMPLE 9

Attenuator is Zinc Sulfate Heptahydrate ($ZnSO_4.7H_2O$)

| component | weight (grams) | percent |
|---|---|---|
| $ZNSO_4.7H_2O$ | 91.75 | 67.99 |
| $H_2O$ | 41.07 | 30.43 |
| Acrylic Resin | 2.11 | 1.56 |
| Silicone Defoamer | .02 | .01 |
| | 134.95 | 99.99 |

EXAMPLE 10

Attenuator is Potassium Sodium Tartrate Tetrahydrate ($KOCOCHOHCHOHCOONa.4H_2O$)

| component | weight (grams) | percent |
|---|---|---|
| $KOCOCHOHCHOHCOONa.4H_2O$ | 54.55 | 59.51 |
| $H_2O$ | 35.86 | 39.12 |
| Acrylic Resin | 1.25 | 1.36 |
| Silicone Defoamer | .01 | .01 |
| | 91.67 | 100.00 |

The following table presents the solids content, sample weight and basis weight of the dried film for Examples 5-10.

TABLE 3

| Further Description of Attenuator Coatings of Examples 1-6 | | | |
|---|---|---|---|
| Mineral Attenuator | Total % Solids Content | Sample Weight (grams) | Basis Weight ($gm/M^2$) |
| Example 5: Alumina Trihydrate | 62 | 0.46 | 29 |
| Example 6: Alumina Trihydrate | 60 | 0.38 | 24 |
| Example 7: Sodium Thiosulfate Pentahydrate | 54 | 0.28 | 17 |
| Example 8: Magnesium Sulfate Heptahydrate | 43 | 0.27 | 17 |
| Example 9: Zinc Sulfate Heptahydrate | 44 | 0.29 | 18 |
| Example 10: Potassium Sodium Tartrate Tetrahydrate | 52 | 0.36 | 22 |

The invention provides several important characteristics and advantages which will now be described. First, the attenuator can be utilized in conjunction with a thin metallized, e.g., aluminized, susceptor layer applied to plastic film such as Mylar® film as shown in FIG. 3 so that the maximum temperature reached can be controlled so as to prevent destructive crazing of the metal layer 52. The invention can also be used for reducing the production of fumes and smoke or volatile substances that would otherwise be driven off during heating from various coating layers contained in the susceptor laminate. In addition, the invention can be used to cool a laminate employed with a food that requires a particular cooking temperature and which may otherwise overheat. For sensitive foods, the invention can be used to produce a substantial amount of heat over a long period of time, thereby providing adequate heating with less chance of burning the food. Another advantage of the invention is that more of the attenuator can be used, for example, when it is incorporated into a sheet of paper than if it were applied as a coated patch to the surface of the paper sheet. By placing the attenuator particles in the paper itself as shown in FIG. 5, it may be possible to reduce the overall cost of the susceptor. In addition, when a hydrated attenuator is used, the water liberated can be used to improve paper characteristics, for example by softening the paper during microwave heating. The attenuator layer can also be used to improve characteristics of the paper and of the susceptor coating (which in accordance with the invention need not contain the attenuator). In addition, the invention allows greater printing press flexibility since one or both of the coatings can be formulated more readily for ease of printing than when the attenuator and susceptor substances are mixed together. Finally, if the attenuator is incorporated into the adhesive as shown in FIG. 6, production can be simplified since adhesive and attenuator are applied simultaneously, thereby improving process efficiency.

Many variations of the present invention within the scope of the appended claims will be apparent to those skilled in the art once the principles described herein are understood.

What is claimed is:

1. A laminate for microwave heating, toasting, browning or crisping foods comprising, a paper backing, a microwave susceptor material as a layer carried by the paper backing for producing heat when exposed to microwave energy, said susceptor layer including a sufficient amount of microwave interactive material for heating of said susceptor material through absorption of microwave energy during heating in a microwave oven, a microwave attenuator separate from the microwave susceptor material, said attenuator is incorporated into the composition of the paper as a part of the paper backing, and the microwave susceptor layer is applied to a surface of the paper as a coating thereon, said attenuator within the paper being associated in heat conductive relationship with the microwave susceptor material layer, said attenuator comprising electrically nonconductive, microwave noninteractive mineral particles present in an amount sufficient to absorb heat and to inhibit overheating of the microwave susceptor layer during heating in a microwave oven.

2. The microwave susceptor construction of claim 1 wherein the susceptor layer is applied to the backing as a patch.

3. The microwave susceptor construction of claim 1 wherein said microwave interactive material includes at least one member selected from the group consisting of carbon, nickel, zinc, tin, chromium, iron, gold, silver, magnesium, copper, manganese, aluminum, cobalt, barium, nickel oxide, zinc oxide, tin oxide, chromium oxide, iron oxide, gold oxide, silver oxide, magnesium oxide, copper oxide, manganese oxide, aluminum oxide, cobalt oxide, barium ferrite, zinc ferrite, magnesium ferrite, copper ferrite, silicon carbide, iron carbide and strontium ferrite.

4. The microwave susceptor construction of claim 1 wherein the attenuator comprises a mineral or a mineral hydrate including at least one member selected from the group consisting of: zinc 1 phenol 4 sulfonate octahydrate; thorium hypophosphate hydrate; magnesium chloroplatinate hexahydrate; thorium selenate hydrate; aluminum oxide trihydrate; zinc iodate dihyrate; thallium sulfate heptahydrate; sodium pyrophosphate hydrate; potassium ruthenate hydrate; manganese chloride tetrahydrate; magnesium iodate tetrahydrate; magnesium bromate hexahydrate; magnesium antimonate hydrate; dysprosium sulfate octahydrate; cobalt orthophosphate octahydrate; calcium ditartrate tetrahydrate; calcium chromate dihydrate; beryllium oxalate trihydrate; magnesium sulfate heptahydrate; potassium sodium tartrate tetrahydrate; and zinc sulfate heptahydrate.

5. The microwave susceptor construction of claim 1 wherein the susceptor material is a dried microwave interactive susceptor coating bonded to a surface of said backing sheet in a position in contact with an adhesive-containing layer.

6. The microwave susceptor construction of claim 1 wherein the attenuator contains an attenuator composition comprising a mineral hydrate attenuator in which water molecules are disassociated from the attenuator material at a temperature below about 500° F. (260° C.).

* * * * *